United States Patent [19]

Day

[11] 4,319,432

[45] Mar. 16, 1982

[54] POLISHING FIXTURE

[75] Inventor: Lawrence Day, Mt. Prospect, Ill.

[73] Assignee: Spitfire Tool and Machine Co., Chicago, Ill.

[21] Appl. No.: 149,348

[22] Filed: May 13, 1980

[51] Int. Cl.[3] ..... B24B 7/22; B24B 37/04

[52] U.S. Cl. ..... 51/131.4; 51/118; 51/216 LP

[58] Field of Search ..... 51/117, 118, 119, 120, 51/131.1, 131.2, 131.3, 131.4, 131.5, 216 R, 216 T, 217 T, 283 R, 133, 216 LP

[56] References Cited

U.S. PATENT DOCUMENTS

| | | | |
|---|---|---|---|
| 1,414,190 | 4/1922 | Koehler | 51/217 T |
| 2,466,610 | 4/1949 | Newman | 51/131.3 X |
| 2,967,380 | 1/1961 | Damgaard | 51/133 |
| 2,983,086 | 5/1961 | La Chapelle | 51/131.2 X |
| 3,233,370 | 2/1966 | Best et al. | 51/131.2 |
| 3,505,766 | 4/1970 | Boettcher et al. | 51/131.2 X |
| 3,559,346 | 2/1971 | Paola | 51/131.4 X |
| 3,631,634 | 1/1972 | Weber | 51/131.4 |
| 3,659,384 | 5/1972 | Day | 51/131.2 |
| 3,860,399 | 1/1975 | Noble et al. | 51/216 LP X |
| 3,886,696 | 6/1975 | Bruck | 51/216 LP |

*Primary Examiner*—James M. Meister
*Assistant Examiner*—Robert P. Olszewski

[57] ABSTRACT

A polishing assembly and fixture providing a vertically movable pressure plate including a depending supporting member for a plurality of workpiece chucks positionable under pressure upon a rotatable polishing lap plate.

5 Claims, 5 Drawing Figures

POLISHING FIXTURE

SUMMARY OF THE INVENTION

The present invention relates generally to a fixture associated with a silicon wafer polishing machine having a rotatable polishing lap plate and a fixture-supporting assembly. The supporting assembly may include a pressure plate which is vertically movable relative to the rotatable polishing plate, with the pressure plate providing depending spindles engageable with individual workpiece chucks, whereby pressure may be applied through the pressure plates onto the chucks and the workpieces carried thereby, as the latter are being polished.

When the polishing fixture of this invention is used with a dual lap machine, the fixture may be carried by a gear plate between the lap surfaces.

Prior apparatuses normally provided a pressure plate having full facial engagement with a workpiece carrier or chuck, and thus when pressure was applied thereby, distortion resulted due to the variations in the height of the workpieces and the engaging surfaces of the pressure plate and the workpiece carrier or chuck.

When the fixture of this invention is used with a machine employing pressure plates, it is an object of this invention to apply uniform pressure during the polishing operation, by providing a pressure plate that has a swivel coupling to its supporting spindle, whereby the pressure plate has a floating action relative to a plurality of workpiece chucks that are in engagement with depending pressure pins provided by the pressure plate. It is desirable that each pin have a free swivel coupling to its respective workpiece chuck so as to minimize deflection between the pressure plate and the chuck when the latter are under pressure.

It is also desired to provide an adjustable reversible workpiece retainer which will position the workpiece beneath and within the periphery of the chuck upon the rotatable lap plate, with the retainer normally being related to the chuck and workpiece so that it is out of contact with the rotatable lap plate during the polishing operation.

GENERAL DESCRIPTION

The invention will be best understood by reference to the accompanying drawings which illustrate the preferred form and mode of construction by which the objects of the invention are achieved, and in which.

Figure 1:
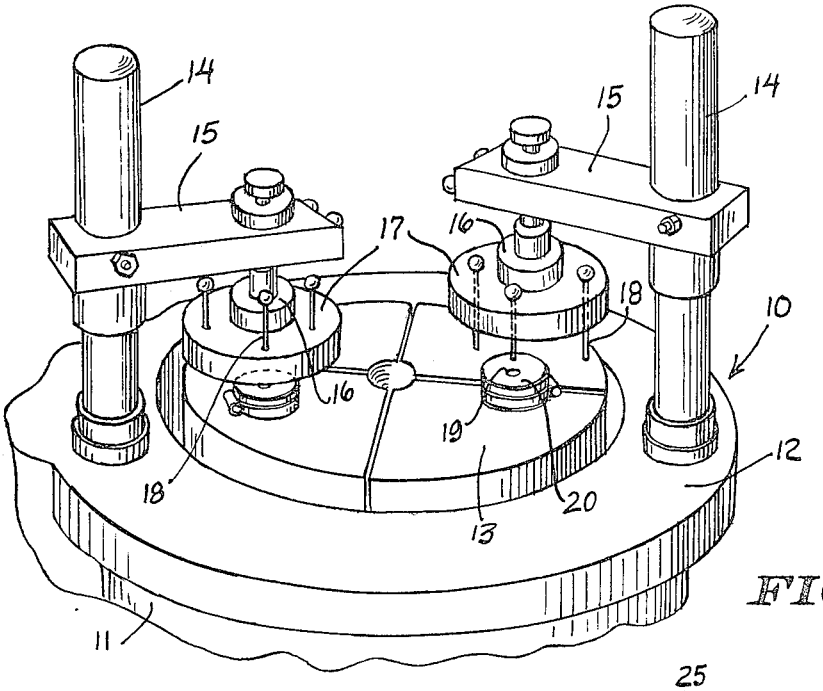
FIG. 1 is a fragmentary perspective view of a polishing machine incorporating the principles of the present invention.
Figure 2:
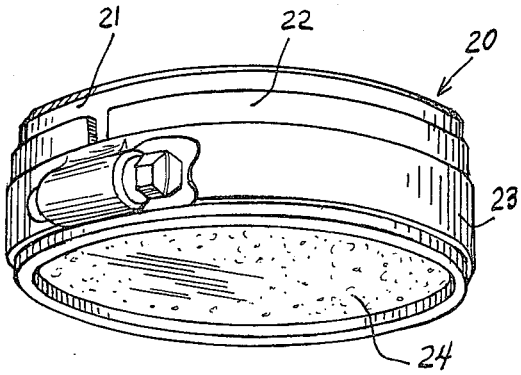
FIG. 2 is a perspective view of the workpiece chuck.

Referring to FIG. 1, there is indicated generally a polishing machine 10, which includes a base portion 11 supporting a horizontal apron 12. This apron 12 surrounds a rotatable polishing lap plate 13. Carried by and extending vertically from the apron 12 are shown a pair of vertical columns 14, each in turn supporting a lateral arm 15. The construction and operation of the vertical columns 14 and the respective lateral arms 15 are of a type well known in the art and make up no part of the present invention except for the environment thereof.

As shown in FIG. 1, each of the lateral arms 15 provides a depending spindle which, through a swivel coupling 16, supports a circular pressure plate 17. The pressure plate 17 is thus movably connected to the lateral arm 15 and the vertical column 14, so that movement vertically thereof and laterally thereof can be achieved, as desired.

The circular pressure plate 17 is provided with a plurality of openings which receive a like number of depending pins 18. The free ends of the pins 18 are adapted to sit within a central recess 19 formed in the top surface of a workpiece chuck 20.

The workpiece chuck 20 consists of a circular body 21 which is adapted to be embraced by a split-ring retainer 22. A stainless steel adjustable band clamp 23 is adapted to embrace the split-ring retainer 22 and secure the same on the periphery of the circular body 21, as shown. The body 21 may be provided with a yieldable circular backup pad 24 which, depending on the application of the fixture, may be constructed of either a hard or soft, and either solid or porous, material, as required.

The split-ring retainer 22 is preferably made from a suitably resilient material, and as such, will have a protective factor, in that it prevents chipping or breakage of the workpiece retained thereby beneath the chuck 20 as the workpiece is subjected to the polishing action of the rotating lap plate 13.

In operation, the workpiece chuck 20 may be removed from the surface of the rotatable polishing lap plate 13 and have a workpiece positioned upon the backup pad 24. The workpiece chuck 20 is then replaced onto the polishing plate 13, generally beneath the pressure plate 17, which would normally be in an elevated position, such as that shown on the right in FIG. 1.

The operator would then forcibly depress the pin 18 so as to be positioned into the recess 19 formed in the top surface of the workpiece chuck 20. By this operation, the center of the workpiece chuck 20 is aligned with the depending pressure pin 19 of the pressure plate 17, such that when the same is lowered into an operating position as shown on the lift of FIG. 1, the components of the apparatus are in position for a work operation.

However, it should be noted that before the chuck 20 has been provided with a workpiece, the dimensions and configurations of the workpiece had previously been determined and, as such, the split-ring retainer 22 had been set so as to project beneath the bottom face or surface of the chuck 20 a distance sufficient to embrace the workpiece so as to retain the same within the periphery of the chuck 20, yet be spaced from the lap plate 13, such adjustment being made easily and quickly through the adjustable band clamp 23.

If by chance, the peripheral bottom edge surface of the retainer 22 becomes nicked, chipped or broken, the retainer 22 may be readily reversed or replaced simply through the adjustment band clamp 23.

By use of the universal swivel reaction between the pressure plate 17 and the work chuck 20, any distortion or deflection between the parts of the fixture is minimized. The pressure plate 17 will have a floating action by reason of the swivel coupling to the spindle 16 permitting it to rotate through its normal horizontal plane, while the centralized exertion of pressure from the pressure plate 17 through pins 18 will permit the work chucks 20 to seek their own horizontal plane, permitting the chuck to assume the profile of the workpieces being polished.

Figure 3:
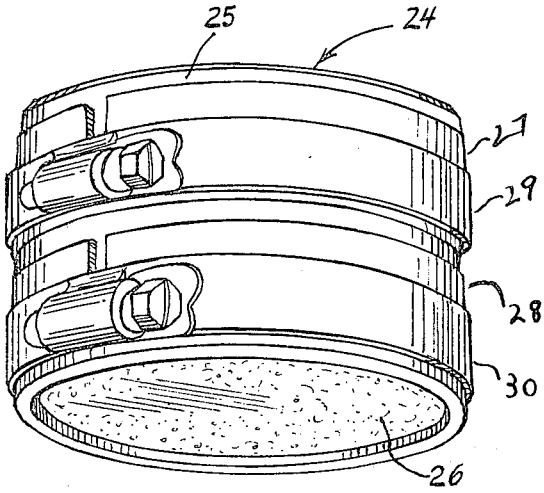
FIG. 3 is a perspective view of the dual face workpiece chuck of this invention.
Figure 4:
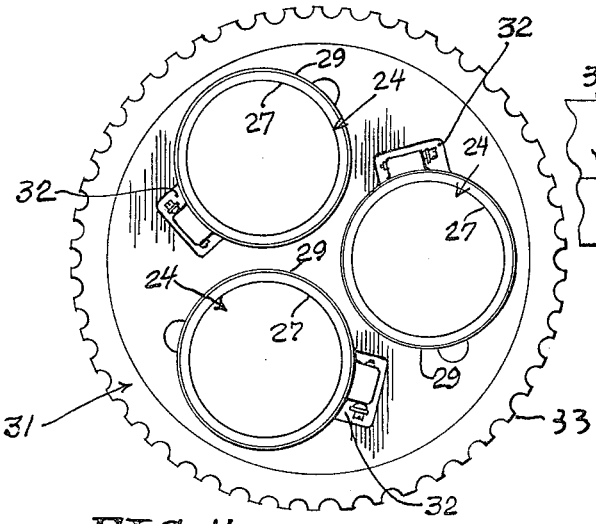
FIG. 4 is a top plan view of the chuck of FIG. 3 positioned within a center gear plate.
Figure 5:
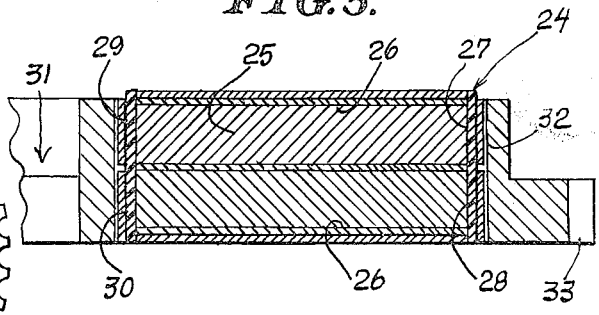
FIG. 5 is a fragmentary detailed sectional view of FIG. 4.

Referring to FIG. 3, there is shown a dual face chuck 24. Basically it is of the same general construction as chuck 20 in that it consists of a circular body 25 having oppositely exposed workpiece receiving faces which may consist of a yieldable backup pad 26. Adapted to embrace the body 25 is a pair of split-ring retainers 27 and 28. Each of the retainers 27 and 28 are removably secured to the body 25 by adjustable band clamps 29 and 30.

It is the purpose of the dual face chuck 24 to be utilized with a dual lap polishing machine; that is, one which will provide two rotating lap plates, with the lap plates arranged so as to simultaneously engage the opposite faces of the chuck 24. To secure the chuck 24 between the lapping plates the machine will provide a positioning disc 31. A positioning disc 31 is provided with a plurality of openings 32 for receiving therein chucks 24. The exterior wall surface of the disc 32 is provided with a series of teeth 33 so the same may be rotated by a drive gear (not shown). The pressure disc 31 is of a type that is readily adaptable for use in lapping machines such as the one described in abandoned application Ser. No. 859,260 filed 12/12/1977 in the name of the current applicant.

In either of the chuck constructions as heretofore described the workpiece retainers may be constructed from split plastic bands and the backup pads may be made from urethane. In the dual face chuck 24 a urethane pad may be provided in the center of the body 25 so as to afford a cushion between the body sections when in use.

The versatility of the split retainers affords longevity to the chucks as well as permitting economical utilization of the part during continuous operation.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A retaining fixture for use with a workpiece polishing assembly having at least one rotatable polishing member including;

(a) a circular workpiece chuck for positioning the workpiece in place to be polished by the assembly, (b) at least one workpiece engaging face provided by said chuck for receiving the workpiece to be polished, (c) means provided by the assembly for maintaining said chuck in a stationary position relative to the rotating polishing member while the workpiece positioned thereby is polished by the rotating polishing member, (d) a reversible, replaceable workpiece retainer embracing the periphery of said chuck and adjustable relative thereto so as to provide an edge exposed beyond the bottom surface thereof for containing the workpiece between the workpiece engaging face and the rotating polishing member, and (e) a means encircling said retainer for maintaining the same on the periphery of said chuck and for permitting adjustment and reversing of said retainer relative to said workpiece engaging face of said chuck.

2. A retaining fixture as defined by claim 1 wherein said reversible, replaceable workpiece retainer comprises a length of resilient material.

3. A retaining fixture as defined by claim 1 wherein said means encircling said retainer or maintaining the same on the periphery of said chuck comprises a band clamp.

4. A retaining fixture as defined by claim 1 including means carried by said workpiece engaging face of said chuck for absorbing irregularities on the face of the workpiece as it is retained beneath the chuck and in contact with the rotating polishing member.

5. A retaining fixture as defined by claim 1 having at least two rotatable polishing members rotating in parallel horizontal planes with said rotating members adapted to polish workpieces placed in engagement with opposite faces of said chuck, and with each face having its periphery embraced by a reversible, replaceable workpiece retainer.

* * * * *